US005079480A

United States Patent [19]

Canale et al.

[11] Patent Number: 5,079,480

[45] Date of Patent: Jan. 7, 1992

[54] BIMETAL/RESISTOR SWITCH AND CERAMIC BRIDGE ASSEMBLY FOR METAL HALIDE LAMPS

[75] Inventors: Joseph E. Canale, Painted Post; Norman R. King, Hammondsport, both of N.Y.

[73] Assignee: North American Philips Corp., New York, N.Y.

[21] Appl. No.: 706,547

[22] Filed: May 28, 1991

Related U.S. Application Data

[63] Continuation of Ser. No. 491,381, Mar. 8, 1990, abandoned.

[51] Int. Cl.[5] ..... H05B 41/06

[52] U.S. Cl. ..... 315/47; 315/60; 315/71; 315/73

[58] Field of Search ..... 315/51, 60, 71, 73, 315/47

[56] References Cited

U.S. PATENT DOCUMENTS

| | | | |
|---|---|---|---|
| 4,097,777 | 6/1978 | Bacharowski | 315/60 |
| 4,179,640 | 12/1979 | Larson et al. | 315/47 |
| 4,437,039 | 3/1984 | Larson | 315/60 |
| 4,445,073 | 4/1984 | Wyner et al. | 315/56 |

OTHER PUBLICATIONS

Photographs of Iwasaki MH175/V High Pressure Sodium Vapor Lamp.

Drawings of Device Similar to GE High Pressure Sodium Vapor Lamp.

*Primary Examiner*—Davis Mis

*Attorney, Agent, or Firm*—William L. Botjer

[57] ABSTRACT

A high pressure lamp assembly having an improved structure for supporting the discharge tube while providing an opening bi-metallic switch for electrically disconnecting the auxiliary electrode. Metallic frames are disposed at the upper and lower ends of the discharge lamp to provide at least partial support to the discharge tube. A non-conductive bridge assembly is connected between the lead through of the auxiliary electrode and a conductive rod extending from the stem. The non-conductive bridge provides at least partial mechanical support to the discharge tube. Connected across the non-conductive bridge is the starting resistor and bi-metallic switch element. When the bi-metallic element is unheated, it provides electrical connection through the starting resistor to the auxiliary electrode. When heated by the heat from the discharge tube, the bi-metallic switch moves out of engagement with the ceramic bridge and thus breaks the electrical connection to the auxiliary electrode.

7 Claims, 2 Drawing Sheets

BIMETAL/RESISTOR SWITCH AND CERAMIC BRIDGE ASSEMBLY FOR METAL HALIDE LAMPS

This is a continuation of application Ser. No. 491,381, filed Mar. 8, 1990 now abandoned.

BACKGROUND OF THE INVENTION

This application relates to electric lamps and particularly to electric lamps having a light source in the form of a discharge tube mounted within an outer envelope.

Electric lamps of the metal halide type include a light source in the form of a discharge tube containing an inert gas and a metal halide filling. The discharge tube is mounted by a frame structure comprised of straps and metal rods within an outer glass envelope. Illumination of the discharge tube is caused by the striking of an arc between upper and lower main electrodes in the discharge tube. In many of these lamps, in order to start the arc an auxiliary (starting) electrode is utilized. The auxiliary electrode is spaced in close proximity to one of the main electrodes. During starting, current is applied by means of starting resistor between one of the main electrodes and the auxiliary electrode to break down the gas and start an arc. In many of these lamps, after the arc is started, the auxiliary electrode is switched out of the lamp circuit. The mechanism for switching the auxiliary electrode out of the circuit is contained within the glass envelope and is usually activated by thermal means such as a bi-metallic element.

Lamp assemblies using a bi-metallic element to disconnect the starting electrode are classified into two types, the opening type and the shorting type. In the opening type the bi-metallic switch is normally closed so that the auxiliary electrode is connected to the current source through the starting resistor. As the lamp warms up the bi-metallic switch element becomes heated, by the heat generated by the discharge tube, the element curves and opens the circuit to the starting electrode. In the shorting type arrangement, the starting resistor is usually disposed in the main circuit and the bi-metallic element, when heated, shorts out the starting resistor to remove it and the auxiliary electrode from the circuit by placing them at the same potential as the main electrodes. Both of these approaches have been, in the past, less than completely satisfactory.

The shorting type of bi-metallic switch generally results in a simplified frame and switch arrangement. However, such designs are often less reliable than the opening type as the proper shorting out of the staring circuit can not be assured as the components age and become oxidized. If the starting circuit is not shorted out catastrophic failure of the discharge tube can result. On the other hand, the opening type of bi-metallic switch arrangement is more reliable and less prone to catastrophic failure. However, these arrangements have resulted in a complex switch and frame structure which does not utilize the switching assembly as part of the frame. Complex frame and switch arrangements make it difficult to utilize automated assembly processes to save on manufacturing costs.

The present invention is directed towards providing a lamp that utilizes the more reliable opening type switch assembly while, at the same time, providing a simple frame arrangement which is suitable for automatic assembly. Furthermore, the present design facilitates the use of single size frame components across different size lamps, thus further minimizing assembly costs.

SUMMARY OF THE INVENTION

The present invention is directed to a lamp assembly having an improved structure for supporting the discharge tube while providing an opening bi-metallic switch for electrically disconnecting the auxiliary electrode. Relatively small frames are disposed at each end of the quartz tube to provide at least partial support for the quartz tube within the outer envelope of the bulb. A non-conductive bridge assembly is connected between the lead through of the auxiliary electrode and the conductive rod extending from the base of the lamp. The non-conductive bridge assembly provides at least partial mechanical support to the discharge tube, thus minimizing its support requirements. Disposed across the bridge assembly is the starting resistor and a bi-metallic switch element. When the bi-metallic element is unheated at starting it provides electrical connection through the starting resistor to the auxiliary electrode. When the bi-metallic element is heated by heat from the discharge tube the bi-metallic switch moves out of engagement with the leads of the non-conductive bridge and thus breaks the electrical connection to the auxiliary electrode. However, the mechanical support of the discharge tube by the non-conductive bridge remains.

Accordingly, it is an object of the present invention to provide a high pressure lamp assembly of the opening bi-metal design having a simplified frame arrangement.

It is another object of this invention to provide an improved lamp assembly in which the bi-metallic switch assembly is utilized to provide partial support to the discharge tube so as to minimize the size of the internal frame.

It is another object of this invention to provide an improved internal frame and auxiliary electrode switch assembly that facilitates automated assembly by placing the majority of the weld points in a common plane.

It is yet another object of this invention to provide an improved design for high pressure lamps that facilitates use of the same parts across different lamp sizes to economize cost of assembly.

BRIEF DESCRIPTION OF THE DRAWINGS

In order to better understand the invention, reference to made to the following drawings which are to be taken in conjunction with the detailed specification to follow.

DETAILED DESCRIPTION OF THE PREFERRED EMBODIMENT

Figure 1:
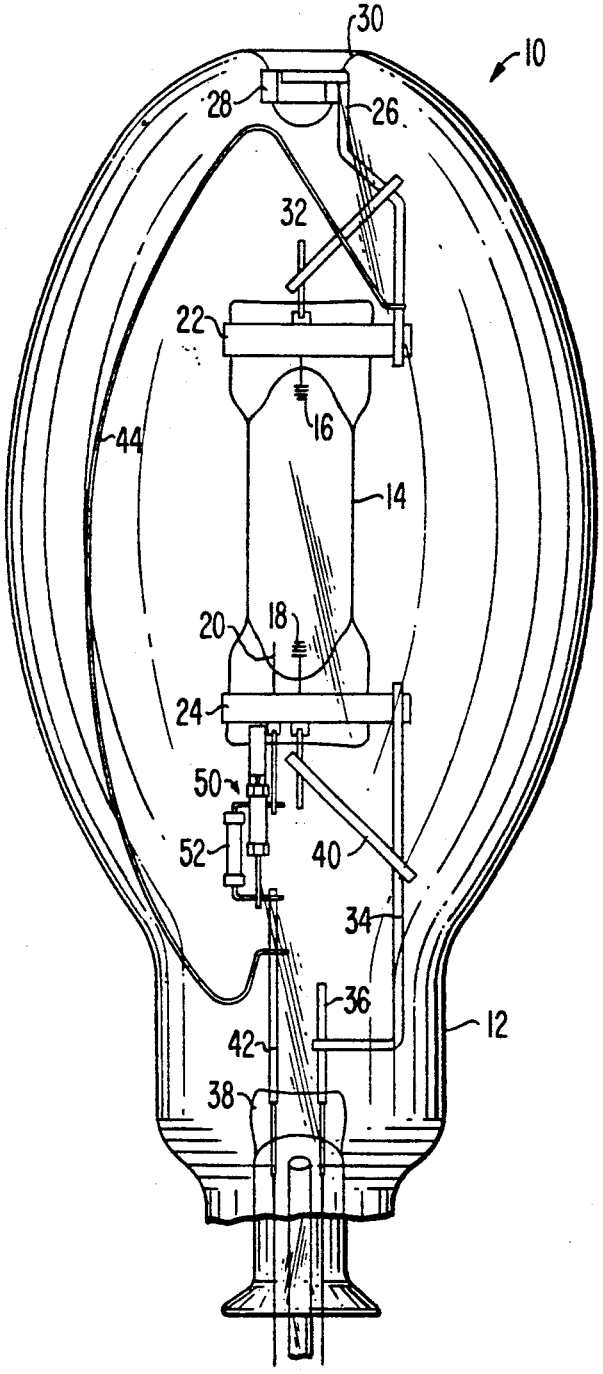
FIGS. 1 and 2 are front and side perspective views of the structure of a high pressure discharge lamp.
Figure 2:
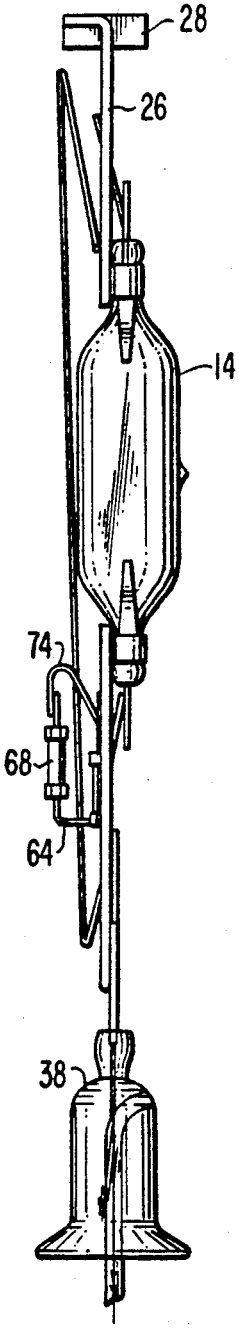

FIGS. 1 and 2 of the drawings illustrate the inventive assembly for a high pressure lamp 10 which includes an outer envelope (bulb) 12 enclosing a discharge tube 14 of the metal halide or other similar types. Disposed at the lower portion of outer envelope 12 is a base (not shown) for releasable attachment to any of the standard connectors for lamps of this type. Discharge tube 14 includes an upper main electrode 16, a lower main electrode 18 and a auxiliary electrode 20. As has been described, the auxiliary electrode is only utilized during the process of starting the arc within discharge tube 14.

After the arc is started, current flows between the upper 16 and lower 18 main electrodes.

Surrounding the upper end of discharge tube 14 is an upper metal strap 22 and surrounding the lower end of discharge tube 14 is a lower strap 24 which are used to connect discharge tube 14 to the support structure within outer envelope 12. Secured to upper strap 22 is an upstanding upper frame member 26 which is secured to a spring clip 28 which surrounds a downwardly projecting dimple 30 at the top of envelope 12. A connector 32 is fixedly secured to frame 26 and is connected to the lead through of upper electrode 16 which provides an electrical connection between frame 26 and upper electrode 16. In similar fashion, lower strap 24 is secured such as by welding to a lower frame 34 which in turn is secured to a rigid inner lead 36 extending from the stem 38 of the lamp. Lead 36 is electrically connected to the external source of current. A connector 40 connects the lead through of lower main electrode 18 and lower frame 34. As is seen in the drawings, the upper and lower frames 26, 34 provide both mechanical positioning of discharge tube 14 as well as electrical connection to main electrodes 16, 18.

A second rigid conductive inner lead 42 carrying the other side of the driving current extends vertically from stem 38. Connected to lead 42 is a field wire 44 which is curved to follow closely the periphery of outer envelope 12 and is also connected to upper frame 26 so as to electrically connect upper electrode 16 to rod 42 through connector 32, frame 26 and field wire 44.

Figure 3:
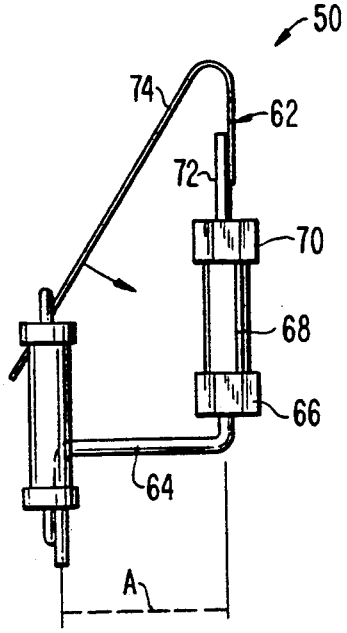
FIGS. 3 and 4 are enlarged perspective views of the ceramic bridge/opening bi-metallic switch assembly of the present construction.
Figure 4:
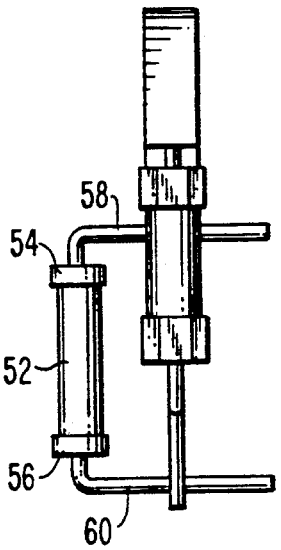

A ceramic bridge/opening bi-metallic switch assembly 50, which is shown in detail in FIGS. 3 and 4, provides mechanical support to the discharge tube 14 as well as thermally disconnectable electrical connection to auxiliary electrode 20. Assembly 50 includes a ceramic, non-conductive cylinder 52 having metallic end caps 54, 56 which are joined to L-shaped upper and lower conductive frames 58, 60. Cylinder 52, end caps 54, 56 and frames 58, 60 can be in the form of a so called "dummy resistor". Lower frame 60 is fixedly attached to the upper portion of rod 42 and upper frame 58 of assembly 50 is connected to the lead through of starting electrode 20. However, since ceramic cylinder 52 is essentially non-conductive, no electric current flows through this path. Cylinder 52 need not be ceramic as other non-conductive materials capable of providing mechanical support may alternatively be used.

The temporary electrical connection to auxiliary electrode 20 used during lamp start-up is provided by the bi-metallic switch assembly 62 which extends out of the plane of discharge tube 14. Bi-metallic switch assembly 62 includes a lower frame 64 which is fixedly joined to frame 60 of ceramic cylinder 52. Frame 64 is connected to the lower end cap 66 of a starting resistor 68 which has an upper end cap 70 and an upper frame portion 72. Joined to upper frame portion 72 is a hair pin shaped bi-metallic element 74 which serves to make and break contact with upper frame portion 58 of ceramic element 52.

When bi-metallic element 74 is unheated, it will be in engagement with upper frame 58 of ceramic element 52, which, because it is joined to the lead through of starting electrode 20, will provide a conductive path from rod 42 to electrically enable auxiliary electrode 20. When bi-metallic element 74 becomes heated by the heat generated by discharge tube 14, it will bend away from engagement with frame 58 to thereby break the electrical connection between rod 42 and starting electrode 20 to electrically disable the starting electrode. The tension of bi-metallic element 74 and thus its opening temperature may be preset and adjusted by varying dimension "A", as shown in FIG. 3 during the assembly process. Other dimensions may also be adjusted to vary the opening temperature.

Although the electrical connection between lead through 42 and auxiliary electrode 20 is broken by the action of bi-metallic element 74, the mechanical support to discharge tube 14 provided by the ceramic bridge 52 remains. It is further noted that the various elements used to support discharge tube 14 are located generally along a single plane. This greatly facilitates the automated assembly and welding of the lamp structure which provides a considerable cost saving in lamps of this type. Furthermore, problems with the deactivation of the auxiliary electrode are greatly reduced by the normally closed design of the bi-metallic switch as well as the capability of using metals less prone to detrimental oxidation in the ceramic bridge/bi-metallic switch assembly 50. Thus, reliability problems are greatly reduced.

Although the present invention has been described in conjunction with a preferred embodiment, it is to be understood that modifications and variations may be resorted to without departing from the spirit and scope of the invention, as those skilled in the art all readily understand. Such modifications and variations are considered to be within the purview and scope of the invention and the appended claims.

What is claimed is:

1. In an electric lamp having an outer envelope, a light source having main electrodes and a auxiliary electrode with associated lead through and first and second conductors for providing current from a point outside of said envelope to within said envelope, the improvement comprising:

frame means for at least partially supporting said light source;

non-conductive bridge means disposed substantially parallel to the longitudinal axis of said light source and mechanically joined between said lead through of said auxiliary electrode and said second conductor to provide at least partial mechanical support to said light source; and thermally activated conductive switch means connected across said non-conductive bridge means, said thermally activated switch means having a first position, when unheated, so as to provide a conductive path across said non-conductive bridge to said auxiliary electrode and a second position, when heated to a predetermined temperature, out of electrical connection to said auxiliary electrode to thereby deactivate same.

2. The electric lamp, as claimed in claim 1, wherein said thermally activated switch means include a starting resistor.

3. The electric lamp as claimed in claim 1 wherein said frame means include upper frame means disposed at the upper end of said light source, said upper frame means being mechanically joined to said light source and said outer envelope to provide mechanical support to said light source.

4. The electric lamp as claimed in claim 1 wherein said non-conductive bridge means is generally U-shaped and includes a ceramic cylinder disposed at the base of said U with the arms of said U being mechanically attached to said lead through of said auxiliary electrode and said second conductor.

5. The electric lamp as claimed in claim 4 wherein said thermally activated switch means has a first end connected to one arm of said U-shaped non-conductive bridge and a second end, which in said first position is in contact with said second end of said U-shaped bridge and which in said second position is out of contact with said second arm of said U-shaped non-conductive bridge.

6. The electric lamp as claimed in claim 3 further including means for electrically connecting said upper frame to one of said main electrodes and means for electrically connecting said upper frame to said second conductor.

7. The electric lamp as claimed in claim 6 wherein said means for connecting said upper frame to said second conductor comprise a curved flexible wire joined to said upper frame and said second conductor, said wire being spaced apart from and conforming to the periphery of said envelope.

* * * * *